US012480377B2

(12) United States Patent
Morrison

(10) Patent No.: US 12,480,377 B2
(45) Date of Patent: Nov. 25, 2025

(54) PUMP DOWN WIPER PLUG ASSEMBLY

(71) Applicant: FORUM US, INC., Houston, TX (US)

(72) Inventor: Jeffery Morrison, Missouri City, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 19/018,868

(22) Filed: Jan. 13, 2025

(65) Prior Publication Data

US 2025/0163771 A1 May 22, 2025

Related U.S. Application Data

(63) Continuation of application No. 18/511,620, filed on Nov. 16, 2023, now Pat. No. 12,221,851.

(51) Int. Cl.
*E21B 33/12* (2006.01)
*E21B 47/117* (2012.01)

(52) U.S. Cl.
CPC ..... *E21B 33/12* (2013.01); *E21B 47/117* (2020.05)

(58) Field of Classification Search
CPC ..... E21B 33/12; E21B 33/1208; E21B 47/117
See application file for complete search history.

(56) References Cited

U.S. PATENT DOCUMENTS

| | | | |
|---|---|---|---|
| 10,260,306 | B1 | 4/2019 | Beckett et al. |
| 11,613,959 | B1 | 3/2023 | McFarlin |
| 2022/0228461 | A1 | 7/2022 | Sims et al. |

OTHER PUBLICATIONS

PCT International Search Report and Written Opinion dated Jan. 29, 2025, for International Application No. PCT/US2024/054346.

*Primary Examiner* — Shane Bomar
(74) *Attorney, Agent, or Firm* — Patterson + Sheridan, LLP

(57) ABSTRACT

Aspects of the present disclosure relate to wellbore plugs, and specifically to pump down wiper plug assemblies used for conducting casing integrity pressure tests and completing wellbores. A plug assembly comprises one or more of a mandrel, a wiper, a plug member, a ring member, and dissolvable member. The dissolvable member, and the plug member and the ring member are configured to temporarily close fluid flow through an inner bore of the mandrel. The entire or only a portion of the outer surface of the dissolvable member comprises a protective coating.

20 Claims, 2 Drawing Sheets

PUMP DOWN WIPER PLUG ASSEMBLY

CROSS-REFERENCE TO RELATED APPLICATIONS

This application is a continuation of co-pending U.S. patent application Ser. No. 18/511,620, filed Nov. 16, 2023, which is herein incorporated by reference in its entirety.

BACKGROUND

Field

Aspects of the present disclosure relate to wellbore plugs, and specifically to pump down wiper plug assemblies used for conducting casing integrity pressure tests and completing wellbores.

Description of the Related Art

Once a wellbore has been drilled, additional steps must be taken to complete the wellbore. For example, a casing string (e.g. large tubular members) is lowered and cemented into the wellbore. When cemented in place, a casing integrity pressure test is conducted to ensure that the casing can safely withstand operating pressures without failure. Fluid flow through the lower end of the casing string must be closed to conduct the pressure test, and then fluid flow through the lower end of the casing string must be re-opened to allow for completion of the wellbore. Current methods of conducting the pressure test, as well as closing and re-opening fluid flow through the lower end of the casing string, are time consuming and require additional tools.

Therefore, there is a need for new and/or improved apparatus and methods for conducting casing integrity pressure tests and completing wellbores.

SUMMARY

In one embodiment, a plug assembly comprises a mandrel having an inner bore. A wiper is coupled to an outer surface of the mandrel. A plug member is coupled to a ring member via one or more releasable members and configured to temporarily close fluid flow through the inner bore of the mandrel. A dissolvable member is coupled to the mandrel and configured to temporarily close fluid flow through the inner bore of the mandrel. The dissolvable member is positioned below the plug member and the ring member. A bottom surface of the dissolvable member comprises a protective coating.

In one embodiment, a method of conducting a wellbore operation comprises pumping a plug assembly through a casing string that is located in a wellbore, wherein the plug assembly sealingly engages a plug seat of the casing string and closes fluid flow through a lower end of the casing string; increasing pressure within the casing until the releasable members release the plug member from the ring member, which allows fluid flow through the ring member and into contact with the dissolvable member, wherein the fluid begins to dissolve the dissolvable member; conducting a casing integrity pressure test, wherein the dissolvable member holds the pressure in the casing string at or greater than a casing integrity pressure; and flowing fluid through the lower end of the casing string when the dissolvable member dissolves.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The disclosure contemplates that terms such as "couples," "coupling," "couple," and "coupled" may include but are not limited to welding, interference fitting, and/or fastening such as by using bolts, threaded connections, pins, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Figure 1:
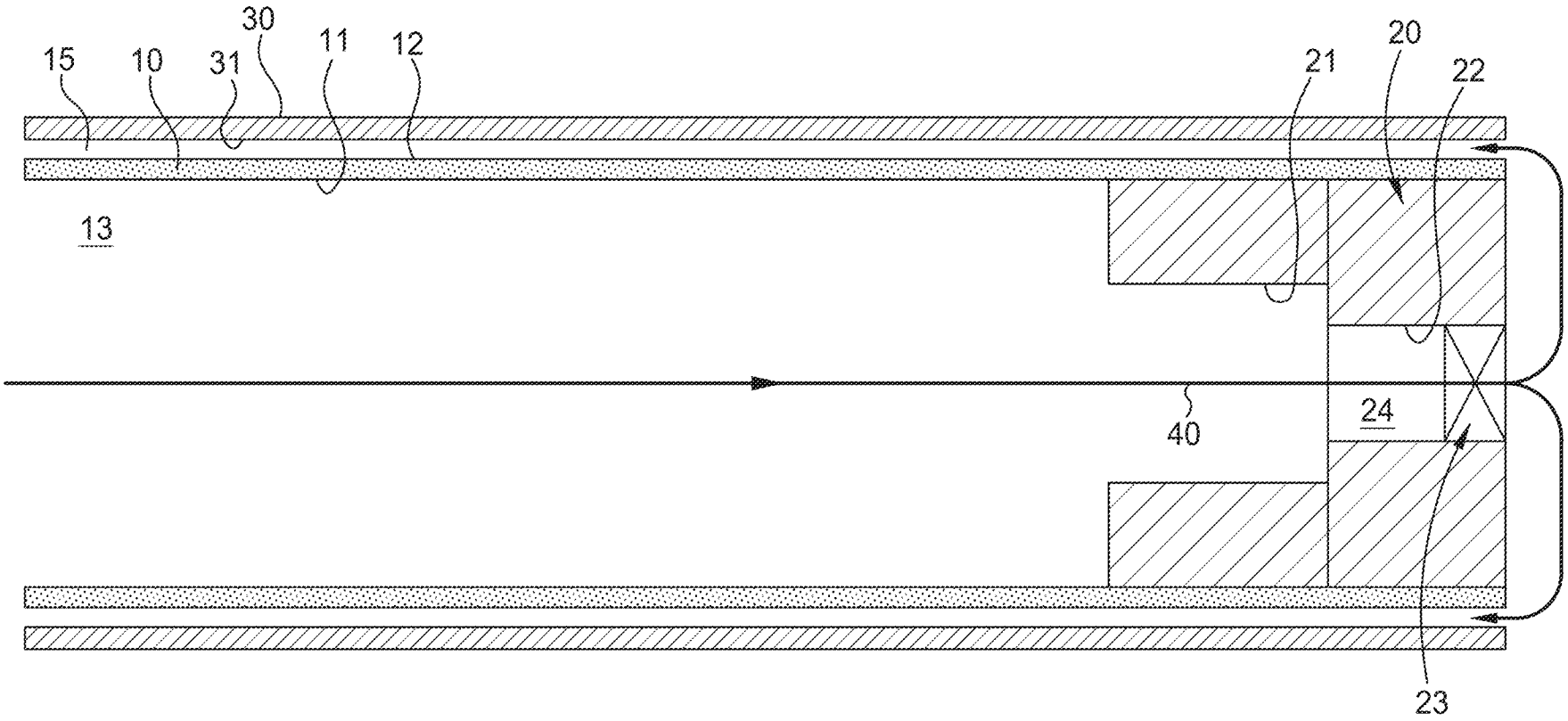
FIG. 1 is a sectional view of a casing string in a wellbore, according to one embodiment.

FIG. 1 is a sectional view of a casing string 10 in a wellbore 30, according to one embodiment. The casing string 10 comprises one or more tubular members coupled together. The casing string 10 has an outer surface 12 and an inner surface 11 that forms an inner bore 13. A casing shoe 20, also referred to as a wet shoe or a float shoe, is coupled to the lower end of the casing string 10. The casing shoe 20 comprises a plug seat 21 and a check valve 23 disposed in an inner bore 24 of the casing shoe 20. The inner bore 24 may have an inner diameter 22 that is less than an inner diameter of the plug seat 21.

As the casing string 10 is being lowered and/or once the casing string 10 is lowered into the desired location in the wellbore 30, a cementing operation is conducted to cement the casing sting 10 in the wellbore 30. Cement 40 is pumped down through the inner bore 13 of the casing string 10 until it flows out through the lower end of the casing string 10. Specifically, the cement 40 flows out through the check valve 23 of the casing shoe 20. The check valve 23 allows fluid flow out through the lower end of the casing string 10 and prevents fluid flow back into the inner bore 13 of the casing string 10. The cement 40 flows out into the wellbore 30 and flows up though an annulus 15 formed between the outer surface 12 of the casing string 10 and an inner surface 31 of the wellbore 30.

After completion of the cementing operation, a casing integrity pressure test is conducted to ensure that the casing string 10 can safely withstand operating pressures without failure. One such type of operating pressure may be when conducting a fracing operation to fracture the wellbore 10 and a highly pressurized fluid is supplied through the casing string 10 into the wellbore 10. The casing string 10 must be able to safely contain and direct the highly pressurized fluid without failure.

To conduct the casing integrity pressure test, fluid flow through the lower end of the casing string 10 must be closed.

After completing the casing integrity pressure test, fluid flow through the lower end of the casing string 10 must be re-opened. The plug assemblies 100 as described herein can be used to close and re-open fluid flow through the lower end of the casing string 10.

Figure 2:
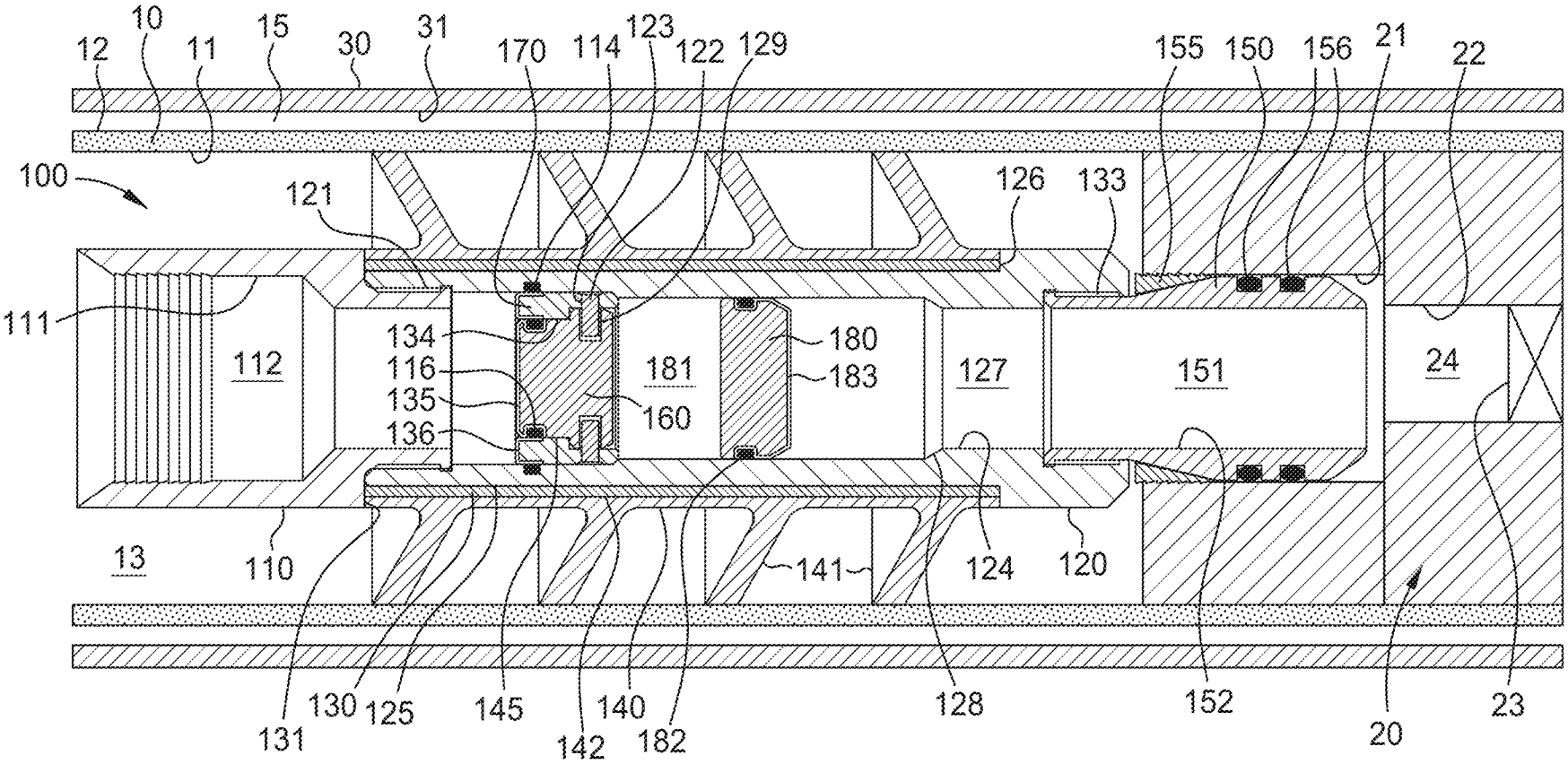
FIG. 2 is a sectional view of a plug assembly disposed in the casing string, according to one embodiment.

FIG. 2 is a sectional view of a plug assembly 100 disposed in the casing string 10, according to one embodiment. The plug assembly 100 is pumped down through the casing string 10 at the end of the supply of cement 40 (as shown in FIG. 1) or sometime after. The plug assembly 100 comprises an upper mandrel 110, a middle mandrel 120, and a lower mandrel 150. An inner surface 111 of the upper mandrel 110 forms an inner bore 112. An inner surface 124 of the middle mandrel 120 forms an inner bore 127. An inner surface 152 of the lower mandrel 150 forms an inner bore 151.

The lower end of the upper mandrel 110 may be coupled to the upper end of the middle mandrel 120 via a connection 121, which may be a threaded connection. One or more sealing members, such as O-rings, may form a seal between the outer diameter of the upper mandrel 110 and the inner diameter of the middle mandrel 120. The lower end of the middle mandrel 120 may be coupled to the upper end of the lower mandrel 150 via a connection 133, which may be a threaded connection. Although the upper, middle, and lower mandrels 110, 120, 150 are illustrated as being solid, single-piece tubular members, the upper, middle, and/or lower mandrel 110, 120, 150 may be formed out of one or more tubular members and/or other components that are coupled together. Similarly, the upper, middle, and/or lower mandrel 110, 120, 150 may be integrally formed with any one or both of the other mandrels.

The lower mandrel 150 further comprises one or more gripping members 155, such as slips, and one or more sealing members 156, such as O-rings. The lower mandrel 150 is sized to land in and engage the plug seat 21 of the casing shoe 20. When the plug assembly 100 is pumped down the casing string 10 and engages the plug seat 21, the gripping members 155 grip against the inner surface of the plug seat 21, and the sealing members 156 seal against the inner surface of the plug seat 21. When the lower mandrel 150 is engaged with the plug seat 21, the inner bore 151 of the lower mandrel 150 is in fluid communication with the inner bore 24 of the casing shoe 20.

The plug assembly 100 further comprises an inner sleeve 130 coupled to an outer surface 125 of the middle mandrel 120, and a wiper 140 coupled to an outer surface 142 of the inner sleeve 130. The inner sleeve 130 and the wiper 140 may be coupled between an outer shoulder 126 of the middle mandrel 120 and an outer shoulder 131 of the upper mandrel 110. The wiper 140 comprises one or more fins 141 in the form of cup-shaped seals configured to seal against the inner surface 11 of the casing string 10. The fins 141 push any fluids, such as the cement 40, down through the inner bore 13 of the casing string 10 and out through the casing shoe 20. The fins 141 may prevent fluids from flowing past the outside of the wiper 140.

The plug assembly 100 further comprises a plug member, referred to herein as a shear plug 160, a ring member, referred to herein as a shear ring 170, and another plug member, referred to herein as a dissolvable member 180, disposed within and coupled to the middle mandrel 120. The dissolvable member 180, and the shear plug 160 and the shear ring 170 are configured to temporarily close fluid flow through the plug assembly 100 as further described below. One or more sealing members 114, such as O-rings, may form a seal between the outer diameter of the shear ring 170 and the inner diameter of the middle mandrel 120. One or more sealing members 116, such as O-rings, may form a seal between the outer diameter of the shear plug 160 and the inner diameter of the shear ring 170.

The shear plug 160 is at least partially disposed within a bore 145 of the shear ring 170, each of which are located within the middle mandrel 120. The shear plug 160 is coupled to the shear ring 170 via one or more releasable members 122, such as shear pins. The one or more releasable members 122 are disposed within one or more openings 123 formed through the sidewall of the shear ring 170 and extend into a groove 129 formed in an outer surface 134 of the shear plug 160. The groove 129 may alternatively be in the form of one or more openings that align with the one or more openings 123 formed in the shear ring 170.

The dissolvable member 180 is located below the shear plug 160 and the shear ring 170 within the middle mandrel 120. The dissolvable member 180 may be formed out of a material that begins to dissolve when in contact with one or more specific fluids. The shear plug 160 and the shear ring 170 may optionally also be formed out of a material that begins to dissolve when in contact with one or more specific types of fluids. The shear plug 160, the shear ring 170, and the dissolvable member 180 may all be formed out of the same dissolvable material or may be formed out of different dissolvable materials. The shear plug 160, the shear ring 170, and/or the dissolvable member 180 may be formed out of magnesium alloys, aluminum alloys, water soluble composites, water soluble plastics, and/or combinations thereof.

The dissolvable member 180 is movable along and relative to the inner diameter of the middle mandrel 120. One or more sealing members 182, such as O-rings, may be coupled to the dissolvable member 180 to form a seal between the outer surface of the dissolvable member 180 and the inner diameter of the middle mandrel 120. The dissolvable member 180 is movable to act as a balance piston, thereby preventing a pressure trap and/or removing any effects caused by hydrostatic pressure as the plug assembly 100 is pumped down the casing string 10. In an alternative embodiment, the dissolvable member 180 is fixed to the inner diameter of the middle mandrel 120 and is not movable.

The shear plug 160 further comprises a coating 135 formed on the outer and inner surfaces of the shear plug 160 that are exposed to fluids in the inner bore 112 of the upper mandrel 110 above the shear plug 160. The shear ring 170 comprises a coating 136 formed on the outer and inner surfaces of the shear ring 170 that are exposed to fluids in the inner bore 112 of the upper mandrel 110 above the shear plug 160. The dissolvable member 180 further comprises a coating 183 formed on the outer and inner surfaces of the dissolvable member 180 that are exposed to fluids in the inner bore 127 of the middle mandrel 120 below the dissolvable member 180.

The coatings 135, 136, 183 may be applied to surfaces of the shear plug 160, the shear ring 170, and the dissolvable member 180, respectively, that are located one side of the sealing members 114, 116, 182. The coatings 135, 136 may be applied to the top surfaces of the shear plug 160 and the shear ring 170, while the bottom surfaces of the shear plug 160 and the shear ring 170 are un-coated. The coating 183 may be applied to the bottom surfaces of the dissolvable member 180, while the top surfaces of the dissolvable member 180 are un-coated. The coatings 135, 136, 183 prevent the shear plug 160, the shear ring 170, and the dissolvable member 180 from dissolving until the desired time.

A non-reactive fluid 181 may be disposed within the area of the middle mandrel 120 between the shear plug 160 and the shear ring 170, and the top surface of the dissolvable member 180. The non-reactive fluid 181 does not react with the shear plug 160, the shear ring 170, or the dissolvable member 180, and similarly prevents the shear plug 160, the shear ring 170, and the dissolvable member 180 from dissolving until the desired time. The surfaces of the shear plug 160, the shear ring 170, and the dissolvable member 180 that are exposed to the non-reactive fluid 181 do not need to be coated with a coating such as coatings 135, 136, 183. The non-reactive fluid 181 may be water, oil, hydrocarbons, high pH fluids (e.g. fluids that have a low acidity), and/or combinations thereof.

In operation, the plug assembly 100 is pumped through the casing string 10. The plug assembly 100 sealingly engages (e.g. lands onto and/or into) the plug seat 21 of the casing shoe 20 and closes fluid flow through the lower end of the casing string 10. The sealing members 156 seal against the plug seat 21, and the fins 141 seal against the inner surface 11 of the casing string 10. In addition, the shear plug 160 and the shear ring 170 prevents fluid flow through the inner bore 127 of the middle mandrel 120. A sudden pressure increase within the casing string 10 above the plug assembly 100 provides an indication that plug assembly 100 has reached and sealed against the plug seat 21 of the casing shoe 20, and that the cement 40 has been pushed through the casing string 10.

A casing integrity pressure test may now begin when the plug assembly 100 engages the plug seat 21. The release force (e.g. the shear force) of the releasable members 122 is set at a pressure less than the casing integrity pressure of the casing string 10. When the casing integrity pressure test begins, the pressure within the casing string 10 is increased and communicated via the inner bore 112 of the upper mandrel 110 to the area above the shear plug 160 and the shear ring 170. The pressure within the casing string 10 is increased until the releasable members 122 release the shear plug 160 from shear ring 170 (such as shearing of the releasable members 122), which allows the shear plug 160 to move out of the shear ring 170 and open fluid flow through the bore 145 of the shear ring 170. When sheared, the non-coated surfaces of the shear plug 160 and the shear ring 170 are exposed to the fluids within the inner bore 13 of the casing string 10 above the plug assembly 100 that flow into the upper and middle mandrels 110, 120. The shear plug 160 and the shear ring 170 begin to dissolve when exposed to the fluids to ensure that fluid can flow through the middle mandrel 120 and into contact with the dissolvable member 180.

The dissolvable member 180 (if not already fixed in place) is moved into a position against a lower inner shoulder 128 of the middle mandrel 120. The dissolvable member 180 then holds the pressure within the casing string 10 and at the same time is exposed to the fluids within the inner bore 13 of the casing string 10 above the plug assembly 100. The dissolvable member 180 is configured to hold the pressure in the casing string 10 at or greater than the casing integrity pressure, and for an amount of time sufficient to complete the casing integrity pressure test, all before the fluids begin to dissolve the dissolvable member 180 to a point where the dissolvable member 180 cannot hold the casing integrity pressure.

After the casing integrity pressure test is complete, fluid flow through the lower end of the casing string 10 is re-opened when the dissolvable member 180 sufficiently dissolves. Specifically, fluids can flow through the inner bores 112, 127, 151 of the upper, middle, lower mandrels 110, 120, 130 of the plug assembly 100 to the inner bore 24 of the casing shoe 20, and then out of the lower end of the casing string 10 through the check valve 23 of the casing shoe 20.

Any one or more components of the plug assemblies 100 may be integrally formed together, directly coupled together, and/or indirectly coupled together, and are not limited to the specific arrangement of components illustrated in the Figures.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

I claim:

1. A plug assembly, comprising:

a tubular member;

a wiper coupled to an outer surface of the tubular member;

a plug member releasably coupled to a ring member and configured to temporarily close fluid flow through an inner bore of the tubular member; and a dissolvable member positioned below the plug member and the ring member and configured to temporarily close fluid flow through the inner bore of the tubular member, wherein at least a portion of the dissolvable member comprises a protective coating, wherein an area between the plug member and the dissolvable member is filled with a non-reactive fluid, and wherein the non-reactive fluid comprises at least one of water, oil, hydrocarbons, low acidity fluids, and combinations thereof.

2. The plug assembly of claim 1, wherein the plug member is releasably coupled to the ring member by one or more shear pins that extend into the plug member and the ring member.

3. The plug assembly of claim 2, wherein the shear pins are disposed within one or more openings formed in the ring member and extend into a groove formed in an outer surface of the plug member.

4. The plug assembly of claim 1, wherein a bottom surface of the dissolvable member comprises the protective coating, and wherein a top surface of the dissolvable member does not comprise the protective coating.

5. The plug assembly of claim 4, wherein top surfaces of the plug member and the ring member comprise a protective coating.

6. The plug assembly of claim 5, wherein bottom surfaces of the plug member and the ring member do not comprise a protective coating.

7. The plug assembly of claim 1, wherein the dissolvable member is movable relative to the tubular member.

8. The plug assembly of claim 1, wherein the dissolvable member comprises at least one of magnesium alloys, aluminum alloys, water soluble composites, water soluble plastics, and combinations thereof.

9. The plug assembly of claim 1, wherein the wiper comprises one or more fins in the form of cup-shaped seals, wherein the tubular member comprises an upper mandrel and a lower mandrel coupled at opposite ends to a middle mandrel, and wherein one or more gripping members and one or more sealing member are coupled to an outer surface of the lower mandrel.

10. The plug assembly of claim 1, wherein one or more sealing members form a seal between an outer surface of the plug member and an inner surface of the ring member.

11. The plug assembly of claim 10, wherein one or more additional sealing members form another seal between an outer surface of the ring member and an inner surface of the tubular member.

12. The plug assembly of claim 1, wherein a predetermined pressure within the tubular member causes the plug member to release from the ring member, which opens fluid flow through a bore of the ring member.

13. A method of conducting a wellbore operation, comprising:

pumping a plug assembly through a casing string that is located in a wellbore, wherein the plug assembly comprises:

a tubular member;

a wiper coupled to an outer surface of the tubular member;

a plug member releasably coupled to a ring member and configured to temporarily close fluid flow through an inner bore of the tubular member; and a dissolvable member positioned below the plug member and the ring member and configured to temporarily close fluid flow through the inner bore of the tubular member, wherein at least a portion of the dissolvable member comprises a protective coating, and wherein the plug assembly sealingly engages a plug seat of the casing string and closes fluid flow through a lower end of the casing string;

increasing pressure within the casing until the plug member releases from the ring member, which allows fluid flow through the ring member and into contact with the dissolvable member, wherein the fluid begins to dissolve the dissolvable member;

conducting a casing integrity pressure test, wherein the dissolvable member is moved into a position against a lower inner shoulder of the tubular member to conduct the casing integrity pressure test, and wherein the dissolvable member holds the pressure in the casing string at or greater than a casing integrity pressure; and flowing fluid through the lower end of the casing string when the dissolvable member dissolves.

14. The method of claim 13, wherein the plug member and the ring member begin to dissolve when exposed to the fluids.

15. The method of claim 13, wherein an area between the plug member and the dissolvable member is filled with a non-reactive fluid, wherein the non-reactive fluid comprises at least one of water, oil, hydrocarbons, low acidity fluids, and combinations thereof.

16. The method of claim 13, wherein the plug member is releasably coupled to the ring member by one or more shear pins that extend into the plug member and the ring member.

17. The method of claim 16, wherein the shear pins are disposed within one or more openings formed in the ring member and extend into a groove formed in an outer surface of the plug member.

18. The method of claim 13, wherein the dissolvable member comprises at least one of magnesium alloys, aluminum alloys, water soluble composites, water soluble plastics, and combinations thereof.

19. A method of conducting a wellbore operation, comprising:

pumping a plug assembly through a casing string that is located in a wellbore, wherein the plug assembly comprises:

a tubular member;

a wiper coupled to an outer surface of the tubular member;

a plug member releasably coupled to a ring member and configured to temporarily close fluid flow through an inner bore of the tubular member; and a dissolvable member positioned below the plug member and the ring member and configured to temporarily close fluid flow through the inner bore of the tubular member, wherein at least a portion of the dissolvable member comprises a protective coating, wherein an area between the plug member and the dissolvable member is filled with a non-reactive fluid, and wherein the non-reactive fluid comprises at least one of water, oil, hydrocarbons, low acidity fluids, and combinations thereof, and wherein the plug assembly sealingly engages a plug seat of the casing string and closes fluid flow through a lower end of the casing string;

increasing pressure within the casing until the plug member releases from the ring member, which allows fluid flow through the ring member and into contact with the dissolvable member, wherein the fluid begins to dissolve the dissolvable member;

conducting a casing integrity pressure test, wherein the dissolvable member holds the pressure in the casing string at or greater than a casing integrity pressure; and flowing fluid through the lower end of the casing string when the dissolvable member dissolves.

20. The method of claim 19, wherein the dissolvable member is moved into a position against a lower inner shoulder of the tubular member to conduct the casing integrity pressure test.

* * * * *